US009157300B2

(12) United States Patent
Edwards

(10) Patent No.: US 9,157,300 B2
(45) Date of Patent: Oct. 13, 2015

(54) SYSTEM AND METHOD FOR CONTROLLING FORMATION FLUID PARTICULATES

(75) Inventor: Jeff S. Edwards, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 357 days.

(21) Appl. No.: 13/008,943

(22) Filed: Jan. 19, 2011

(65) Prior Publication Data

US 2012/0181024 A1 Jul. 19, 2012

(51) Int. Cl.
*E21B 43/04* (2006.01)
*E21B 43/08* (2006.01)

(52) U.S. Cl.
CPC ..... *E21B 43/045* (2013.01); *E21B 43/04* (2013.01); *E21B 43/08* (2013.01)

(58) Field of Classification Search
CPC ..... E21B 43/04; E21B 43/08; E21B 43/088; E21B 43/086; E21B 43/082; E21B 43/045; E21B 43/084
USPC ..... 166/278, 276, 296, 51, 56, 205, 166/227–236, 242.5
See application file for complete search history.

(56) References Cited

U.S. PATENT DOCUMENTS

| | | | | |
|---|---|---|---|---|
| 4,674,572 | A | 6/1987 | Gallus | |
| 5,332,038 | A | 7/1994 | Tapp et al. | |
| 5,341,880 | A | 8/1994 | Thorstensen et al. | |
| 5,868,200 | A | 2/1999 | Bryant et al. | |
| 6,230,803 | B1 | 5/2001 | Morton et al. | |
| 6,540,022 | B2 * | 4/2003 | Dusterhoft et al. | 166/278 |
| 6,588,506 | B2 | 7/2003 | Jones | |
| 7,207,383 | B2 | 4/2007 | Hurst et al. | |
| 7,478,651 | B2 | 1/2009 | Simpson | |
| 7,584,799 | B2 | 9/2009 | Coronado et al. | |
| 7,661,476 | B2 | 2/2010 | Yeh et al. | |
| 2003/0047311 | A1 | 3/2003 | Echols | |
| 2004/0035579 | A1 | 2/2004 | Parlar | |
| 2004/0140089 | A1 | 7/2004 | Gunneroed | |
| 2005/0028977 | A1 | 2/2005 | Ward | |
| 2005/0061501 | A1 * | 3/2005 | Ward et al. | 166/278 |
| 2006/0237197 | A1 | 10/2006 | Dale | |
| 2006/0283604 | A1 | 12/2006 | Setterberg et al. | |

(Continued)

OTHER PUBLICATIONS

For the American Heritage Dictionary definition: AT. (n.d.) The American Heritage® Dictionary of the English Language, Fourth Edition. (2003). Retrieved Apr. 22, 2014 from http://www.thefreedictionary.com/at.*

(Continued)

*Primary Examiner* — Shane Bomar
*Assistant Examiner* — Wei Wang
(74) *Attorney, Agent, or Firm* — Cantor Colburn LLP

(57) ABSTRACT

A gravel packing apparatus includes: a screen assembly including at least one screen configured to be disposed in a borehole in an earth formation, the screen configured to prevent particulate matter from passing therethrough; an axially extending conduit configured to transmit a gravel slurry from a remote location to a borehole region located between the screen and a portion of the borehole wall; and an exit port including an opening having a first end in fluid communication with the conduit and a second end in fluid communication with the borehole region, the exit port including at least one standoff member extending radially from the second end and configured to prevent blockage of the opening.

8 Claims, 4 Drawing Sheets

(56) References Cited

U.S. PATENT DOCUMENTS

| | | | | |
|---|---|---|---|---|
| 2007/0131421 | A1 | 6/2007 | Hurst et al. | |
| 2008/0190608 | A1 | 8/2008 | Coronado et al. | |
| 2009/0188666 | A1 | 7/2009 | Habib et al. | |
| 2010/0155064 | A1 | 6/2010 | Nutley et al. | |
| 2013/0248179 | A1* | 9/2013 | Yeh et al. | 166/278 |

OTHER PUBLICATIONS

Sanders et al. "Gravel Pack Designs of Highly-Deviated Wells with an Alternative Flow-Path Concept." International Symposium and Exhibition on Formation Damage Control, Feb. 20-21, 2002, Lafayette, Louisiana. [Abstract and Introduction Only].

Edment, "Improvements in Horizontal Gravel Packing". Oilfield Review. Spring 2005, pp. 50-60.

Notification of Transmittal of the International Search Report and the Written Opinion of the International Searching Authority, or the Declaration; PCT/US2011/063491; Jul. 25, 2012.

International Search Report and Written Opinion; Date of Mailing Jul. 18, 2012; International Applcation No. PCT/US2011/065837; Korean Intellectual Property Office; Internaltional Search Report 5 pages; Written Opinion 4 pages.

* cited by examiner

SYSTEM AND METHOD FOR CONTROLLING FORMATION FLUID PARTICULATES

BACKGROUND

Various tools are utilized in the hydrocarbon exploration, drilling and completion industry to increase or maximize production efficiency. Sand control devices such as gravel packs are utilized to control the ingress of particulate contaminants into production fluid and to aid in stabilizing production formations.

When gravel packing joints or components are lowered into a borehole, there is potential for gravel slurry exit or injection ports to be impeded by, for example, a borehole casing or side wall. This has the potential to reduce the effectiveness and/or efficiency of deployment of gravel packs or other completion tools.

BRIEF DESCRIPTION OF THE INVENTION

A gravel packing apparatus includes: a screen assembly including at least one screen configured to be disposed in a borehole in an earth formation, the screen configured to prevent particulate matter from passing therethrough; an axially extending conduit configured to transmit a gravel slurry from a remote location to a borehole region located between the screen and a portion of the borehole wall; and an exit port including an opening having a first end in fluid communication with the conduit and a second end in fluid communication with the borehole region, the exit port including at least one standoff member extending radially from the second end and configured to prevent blockage of the opening.

A method of controlling particulates in downhole fluid comprising: deploying a packing apparatus in a borehole in an earth formation, the apparatus including a screen assembly including at least one screen configured to prevent particulate matter from passing therethrough, an axially extending conduit, and an exit port including an opening having a first end in fluid communication with the conduit and a second end in fluid communication with a borehole region, the exit port including at least one standoff member extending radially from the second end and configured to prevent blockage of the opening; injecting a gravel slurry through the axially extending conduit and the exit port into the borehole region located between the screen and a portion of the borehole wall via the axially extending conduit; and pumping the slurry to the screen and depositing gravel in the borehole region to form a gravel pack in the borehole region.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

There is provided a system and method for controlling sand and other particulates in a downhole environment. A gravel packing system includes an emitter assembly and a screening assembly. The screening assembly includes at least one screen disposed between an annular region of a borehole and a production conduit in a borehole string or other carrier. The emitter assembly includes at least one conduit configured to provide a gravel slurry to a downhole location, and an exit port. The exit port includes or is operably connected to a standoff portion configured to maintain the exit port a distance away from the side of the borehole or away from other components to allow the gravel slurry to pass through into the annular region and prevent blockages. Blockages can occur due to conditions where the emitter assembly is forced against or near the borehole wall or other downhole components due to factors such as gravity, hole inclination and side forces induced by pipe buckling or tension.

Figure 1:
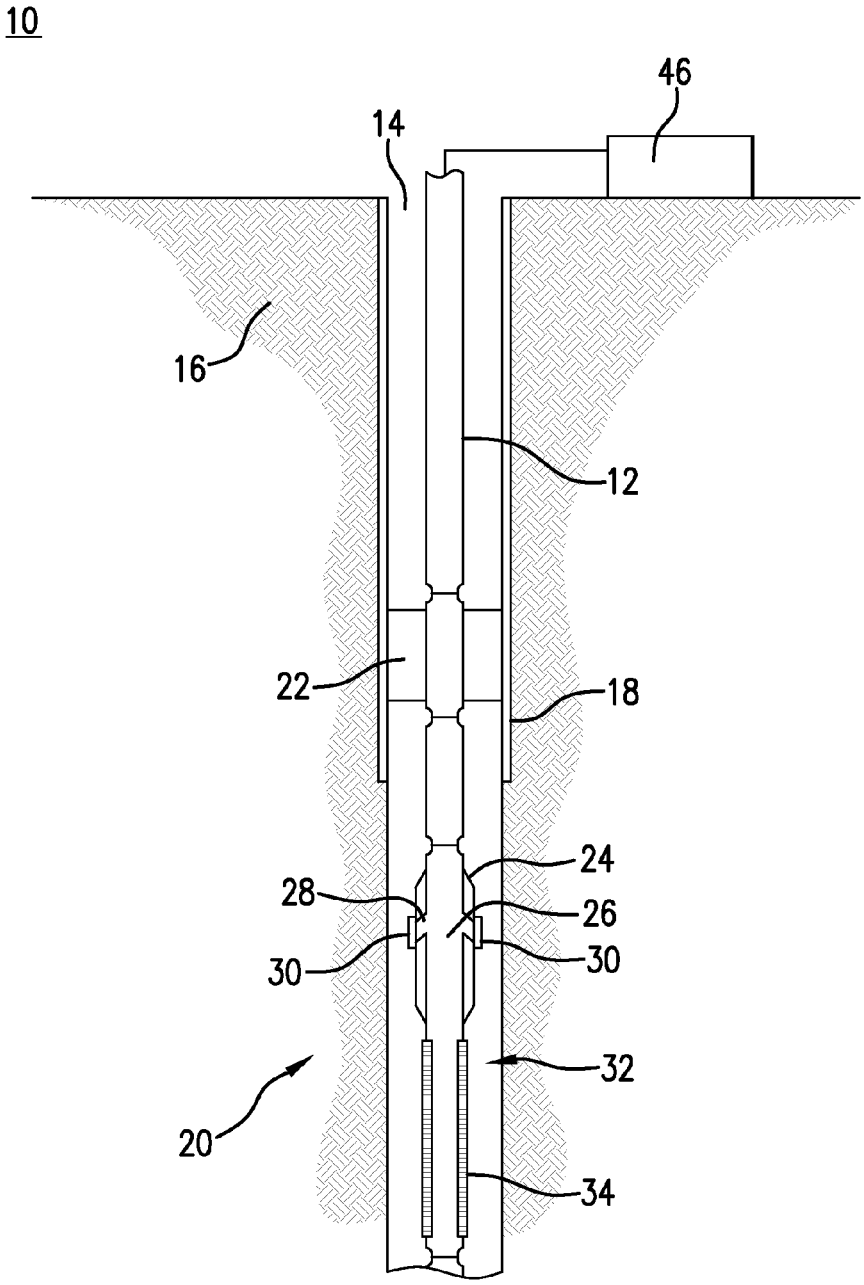
FIG. 1 depicts an embodiment of a downhole completion and/or production system including a gravel packing tool.

Referring to FIG. 1, an exemplary embodiment of a downhole completion and/or production system 10 includes a borehole string 12 that is shown disposed in a borehole 14 that penetrates at least one earth formation 16. The borehole 14 may be an open hole or an at least partially cased hole having a casing 18, and may be generally vertical or include a horizontal component. As described herein, "formations" refer to the various features and materials that may be encountered in a subsurface environment. A "borehole string", as used herein, refers to any structure or carrier suitable for lowering a tool through a borehole and/or connecting a tool to the surface, and is not limited to the structure and configuration described herein. A "carrier" as described herein means any device, device component, combination of devices, media and/or member that may be used to convey, house, support or otherwise facilitate the use of another device, device component, combination of devices, media and/or member. Exemplary non-limiting carriers include borehole strings of the coiled tube type, of the jointed pipe type and any combination or portion thereof. Other carrier examples include casing pipes, wirelines, wireline sondes, slickline sondes, drop shots, downhole subs, bottom-hole assemblies, and drill strings.

The system includes a downhole packing tool 20 such as a gravel packing tool. The packing tool 20 is configured to prevent production of formation sand or other particulates as borehole fluid, i.e., production fluid, is produced from the formation 16. The packing tool 20 may be incorporated in the borehole string 12 as, for example, a packer sub or joint. The packing tool 20 may also be incorporated in the borehole string 12 with additional downhole components, such as an additional packer 22 and various fluid control tools.

As shown in FIG. 1, the packing tool 20 includes an emitter assembly 24 configured to pump, inject or otherwise introduce a gravel slurry into a selected borehole region. The emitter assembly includes at least one fluid conduit such as a gravel slurry conduit 26 in fluid communication with a gravel slurry source. The gravel conduit 26 may be a tubular conduit extending axially (i.e., extending at least partially in a direction generally parallel to a longitudinal axis of the borehole 14) from a surface location to a downhole location. The gravel slurry includes a flowable component such as a liquid and a gravel component such as sand. Gravel, as referred to herein, includes any type of filtering material that can be injected into a borehole region and includes rock, mineral or other particles sized to prevent sand or other particulate matter in production fluid from passing therethrough.

The emitter assembly 24 also includes an exit port 28 providing fluid communication between the gravel conduit 26 and a selected borehole region. In one embodiment, the selected borehole region, or gravel pack region, is an annular region between the downhole packing tool 20 and the borehole wall and/or casing 18. Each exit port 28 includes a standoff portion 30 that extends from an outermost portion of the exit port 28 toward an exterior of the emitter assembly 24, and is configured to maintain a separation between the exit port 28 and the borehole wall and/or any downhole component that may come into contact with the exit port 28. The standoff portion 30 acts to prevent or reduce blockage that can occur, for example, if the emitter assembly 24 is pressed against the side of the borehole 14, casing or other downhole components.

In one embodiment, the exit port 28 includes an opening having a first end in fluid communication with the gravel conduit 26 and a second end in fluid communication with the gravel pack region, and extends at least partially radially from the gravel conduit 26. As described herein, "radial" refers to a direction away from and perpendicular to a central longitudinal axis of the borehole 14 and/or the string 12. In one embodiment, the standoff portion 30 includes one or more members that extend radially away from the second end.

The packing tool 20 also includes a filtering or screening assembly 32 that includes at least one screen 34. The screen 34 is configured to allow fluid flow therethrough but exclude particulate matter such as produced sand. The screen may be, for example, a cylindrical member made of aluminum, steel or other suitable material and include a woven, perforated or any other configuration sufficient to exclude undesired sand or other particulate matter.

Figure 2:
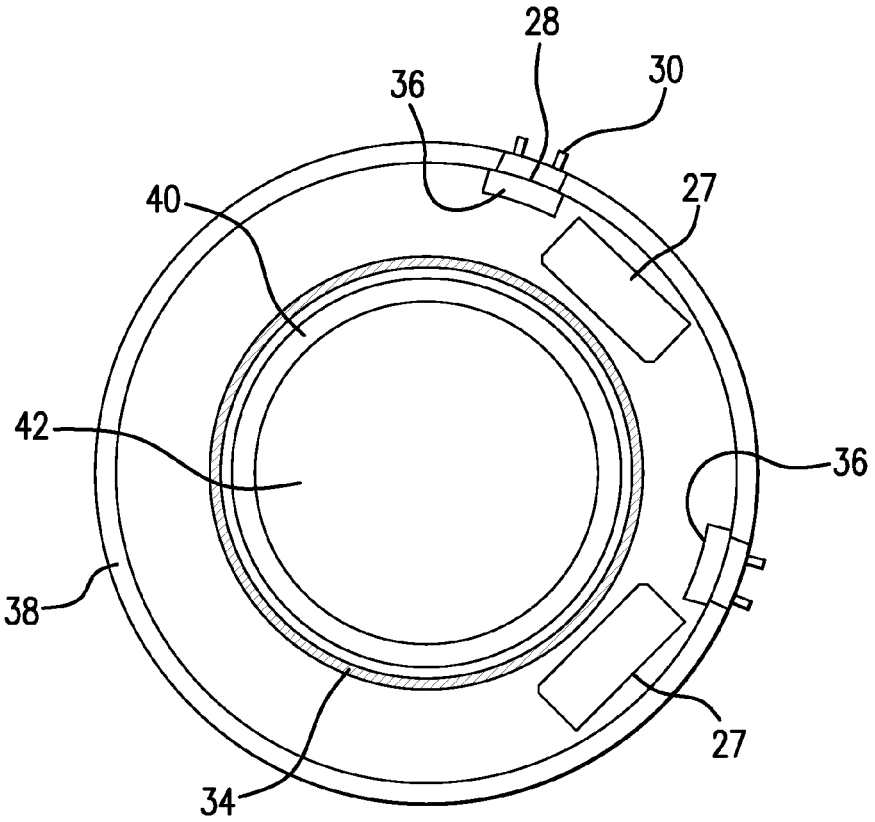
FIG. 2 is a cross-sectional view of a portion of an embodiment of the gravel packing tool of FIG. 1.

The emitter assembly 24 and the screening assembly 32 may be configured in any desired manner sufficient to allow the gravel slurry to be injected to the packing zone and to allow fluid to flow from the packing zone into the borehole string 12. For example, the emitter assembly 24 and the screening assembly 32 may be incorporated into a single joint, downhole sub, pipe segment or string segment as shown in FIG. 2. In other example, the emitter assembly and the screen assembly are configured as separate joints, subs or other components that are connected to a borehole string 12 or otherwise disposed in operable communication with each other.

In one embodiment, shown in FIG. 2, the packing tool 20 is a secondary path or multi-path gravel packing tool. In this embodiment, the gravel conduits 26 include one or more slurry tubes 27 extending axially along the borehole string 12 and configured to transport a gravel slurry downhole. Each slurry tube 27 is connected to at least one injection or emission conduit 36 that is in fluid communication with a respective slurry tube 27 and extends to an exit port 28. In one embodiment, each slurry tube 27 is connected to a plurality of emission conduits 36 and associated exit ports 28 that are axially arrayed along a length of the packing tool 20. In one embodiment, the packing tool 20 includes a protective cover 38 disposed around the slurry tubes 27 and the conduits 36. The exit ports 28 may be configured to provide a fluid path from an interior of the cover 38 to an exterior of the cover 38.

The exit ports 28 may each include a standoff portion 30 that extends radially from the exit port 28 and the protective cover 38. The standoff portion 30, in one embodiment, includes one or more protrusions or members that are disposed as part of the exit port 28 or the protective cover 38 and are located proximate to the second or outer end of the exit port opening. Each standoff member 30 may be attached to integrated into the exit port 28 or the protective cover 38.

In one embodiment, the emitter assembly 24 is co-located with at least a portion of the screening assembly 32. For example, as shown in FIG. 2, the emitter assembly 24 is disposed around the screen 34, which is in turn disposed around a base pipe 40 that defines a part of a production conduit 42 through which formation fluid flows from the formation 16 to the surface.

Figure 3:
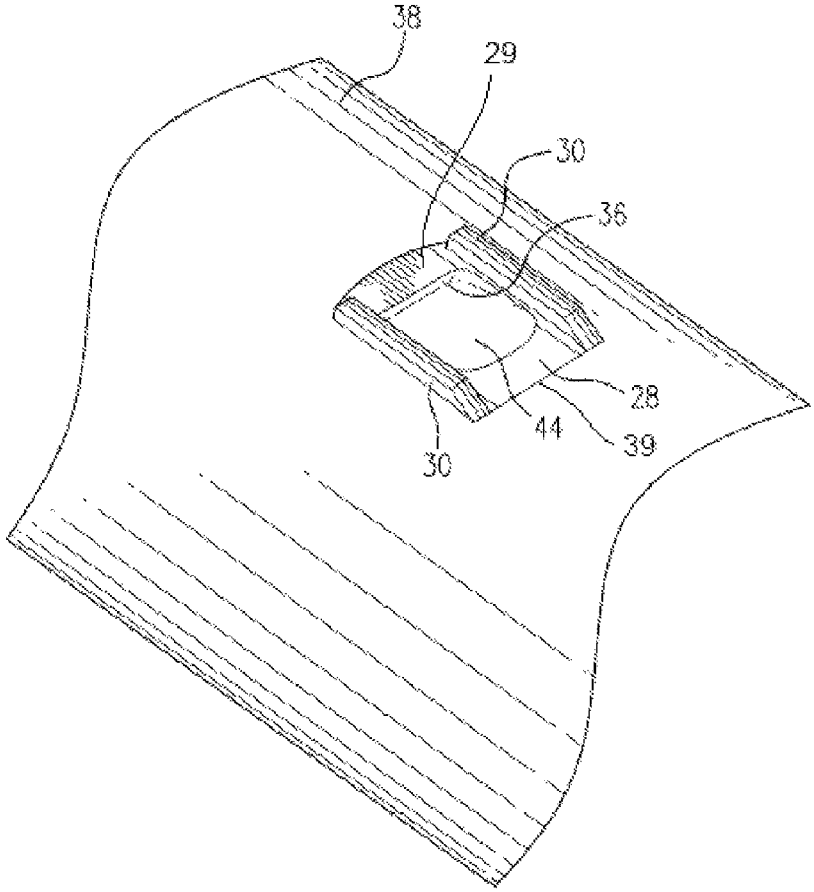
FIG. 3 is a perspective view of a portion of the gravel packing tool of FIG. 2.

FIG. 3 illustrates a close-up view of an exemplary exit port 28 that may be used in various packer tools such as the exemplary tool 20 shown in FIG. 2. The emitter assembly 24 in this example is disposed at least partially within the protective cover 38. The protective cover 38 may define and/or include therein one or more gravel slurry conduits 26, slurry tubes 27, emission conduits 36, screens 34 and/or production conduits 42. In one embodiment, the protective cover 38 is included as a pipe segment or joint. The emitter assembly 24, in one embodiment, extends from the protective cover 38 to other components such as the base pipe 40 inside the cover. The cover 38 may be configured to take all loads imposed from the standoff portions 30 that come into contact with the borehole 14 or other downhole components, or may be configured to transfer the loads to the base pipe 40 or other carriers.

In one embodiment, each exit port 28 is designed to conform to an interior surface of the protective cover 38. In the example shown in FIG. 3, the exit port 28 includes an outlet opening 44 that at least partially radially extends from the interior surface of the protective cover 38 toward an exterior surface of the cover 38. The outlet opening 44 extends to a point at or near the exterior surface, and the standoff portion 30 includes protruding members that extend outwardly radially from the exterior surface. In one example, the exit port 28 is a cast metal (e.g., steel, aluminum) component including the exit port opening and standoff members 30, and is configured to be welded or otherwise attached to the protective cover 38. In one embodiment, the protective cover 38 includes a cover opening 39 of a size and shape configured to allow the standoff members 30 to extend away from the exterior surface.

For example, the cover 38 includes a hole that is wide enough and long enough to accommodate passage of the standoff members 30, but shorter than the overall length of the exit port 28 to allow the exit port 28 to be secured (e.g., welded) to the interior of the protective cover 38. The exit port body 29 extends axially or otherwise is configured to extend a sufficient distance (e.g., ¼inch) to allow the standoff members 30 to extend through the opening while allowing the body 29 to be secured to the cover 38.

In one embodiment, the packing tool 20 is equipped for operable and/or fluid communication with a surface unit 46. The surface unit 46 may be configured to pump or otherwise inject gravel slurry into the conduits 26. The surface unit 46 may also include one or more processing units, and the tool 20 and/or other components of the borehole string 12 may include transmission equipment to communicate ultimately to a surface processing unit 24. Such transmission equipment may take any desired form, and different transmission media and methods may be used. Examples of connections include wired, fiber optic, wireless connections or mud pulse telemetry.

Figure 4:
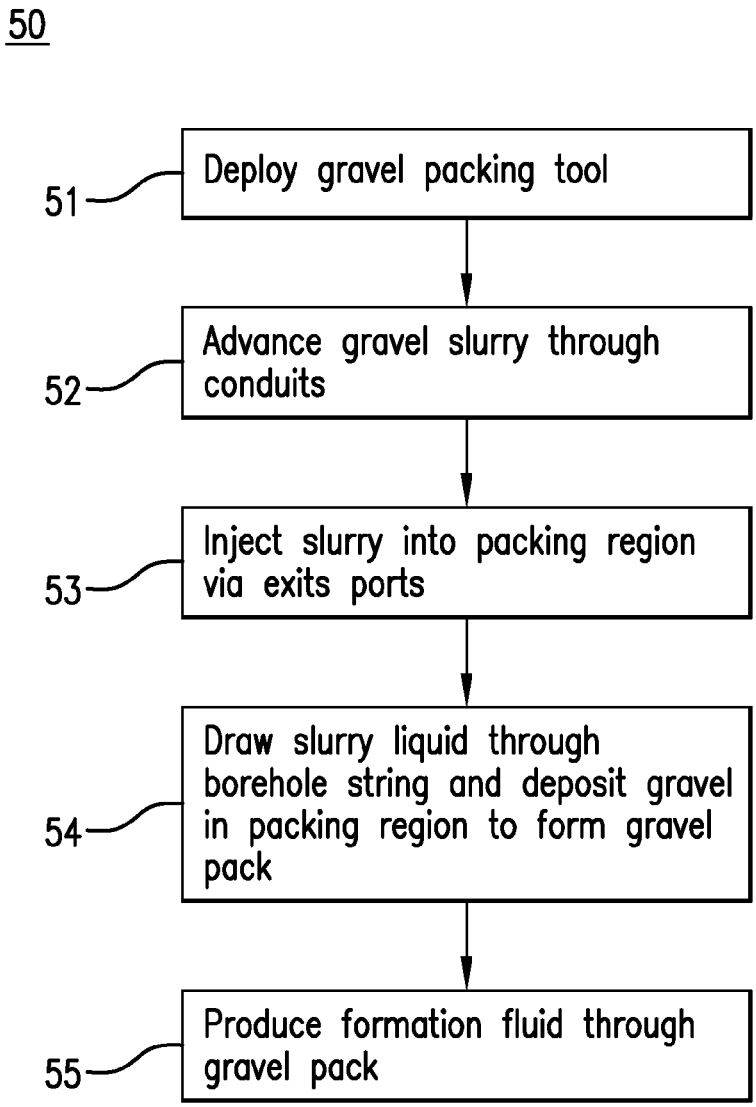
FIG. 4 is a flow diagram depicting a method of controlling production fluid in a borehole.

FIG. 4 illustrates a method 50 of controlling particulates such as produced sand in a borehole. The method is performed in conjunction with a gravel packing tool such as the tool 20. The method 50 includes one or more stages 51-55. Although the method is described in conjunction with the tool 20, the method can be utilized in conjunction with any gravel packing device or system.

In the first stage 51, in one embodiment, the packing tool 20 is deployed to a downhole location, via for example a borehole string 12 or wireline. In the second stage 52, a gravel slurry is pumped or otherwise advanced through the borehole string 12 via, for example, the gravel conduit 26 and/or slurry tube(s) 27, and exits into an annular region of the borehole 14 through one or more exit ports 28. The gravel slurry includes a gravel material such as natural sand or synthetic materials having grains sized to exclude produced sand or other undesired particulates. A standoff structure such as the standoff members 30 associated with each exit port 28 helps to prevent the gravel slurry from being obstructed by the borehole wall, casing or other downhole component. In the third stage 53, the gravel slurry flows through the annular region and to one or more screens 34, which are sized or configured to prevent gravel particles in the slurry from passing therethrough. In the fourth stage 54, the gravel particles collect in the annular region and form a gravel pack in the annular region and/or around the screens 34. In the fifth stage 55, formation fluid is produced from the formation 16 by flowing the formation fluid through the gravel pack and the screen and through the borehole string 12.

The systems and methods described herein provide various advantages over prior art techniques. For example, the emitter assembly provides an improved configuration for facilitating injection of the gravel slurry or other packing material into the packing zone, and also provides protection from blockage of the exit ports due to various conditions such as hole inclination and buckling that can cause obstruction of the exit ports.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A gravel packing apparatus comprising:

a screen assembly including at least one screen configured to be disposed in a borehole in an earth formation, the screen configured to prevent particulate matter from passing therethrough;

an axially extending conduit configured to transmit a gravel slurry from a remote location to a borehole region located between the screen and a portion of a borehole wall;

an axially extending tubular component surrounding a portion of the axially extending conduit, the borehole region at least partially defined by an exterior surface of the axially extending tubular component and the portion of the borehole wall; and at least one exit port including a body extending through a wall of the axially extending tubular component, the body including an opening having a first end in fluid communication with the axially extending conduit and a second end in fluid communication with the borehole region, the entirety of the second end terminating at the exterior surface of the axially extending tubular component and flush with the exterior surface of the axially extending tubular component, the body including at least one standoff member integrated into the exit port and extending radially into the borehole region from the second end and from the exterior surface and configured to prevent blockage of the opening, wherein the axially extending tubular component is a protective axially extending tube having a tube opening in the wall configured to receive the exit port, the opening being large enough to allow the body to be inserted through the tube opening so that the at least one standoff member extends radially away from the external surface and small enough to prevent the remainder of the body from extending radially from the external surface into the borehole region.

2. The apparatus of claim 1, further comprising at least one emission conduit extending from the axially extending conduit to the at least one exit port.

3. The apparatus of claim 2, wherein the at least one emission conduit is a plurality of the at least one emission conduit, the at least one exit port is a plurality of the at least one exit port, the plurality of the at least one emission conduit and the plurality of the at least one exit port are in fluid communication with the axially extending conduit and arrayed axially along the apparatus.

4. The apparatus of claim 1, wherein the tube opening extends at least partially radially from an interior surface of the protective axially extending tube to an exterior surface of the protective axially extending tube.

5. The apparatus of claim 4, wherein the at least one standoff member extends radially from the exterior surface.

6. The apparatus of claim 4, wherein the body includes an outer surface that generally conforms to a shape of the exterior surface of the protective axially extending tube.

7. The apparatus of claim 6, wherein the at least one standoff member extends radially from the outer surface of the exit port.

8. The apparatus of claim 6, wherein the protective axially extending tube has the tube opening configured to allow the standoff members to extend therethrough and to allow the body to be secured to the axially extending tubular component.

* * * * *